US011635049B1

(12) United States Patent
Hamby et al.

(10) Patent No.: US 11,635,049 B1
(45) Date of Patent: Apr. 25, 2023

(54) AIR INDUCTION SYSTEM INCLUDING AIR DUCT HAVING CYLINDRICAL WALL WITH OPENING EXTENDING RADIALLY THERETHROUGH AND FEATURE FOR MINIMIZING AIRFLOW DISTURBANCES CAUSED BY PRESENCE OF OPENING

(71) Applicant: MANN+HUMMEL GmbH, Ludwigsburg (DE)

(72) Inventors: Stephen J Hamby, New Hudson, MI (US); Robert VanHulle, Battle Creek, MI (US)

(73) Assignee: MANN+HUMMEL GmbH, Ludwigsburg (DE)

( * ) Notice: Subject to any disclaimer, the term of this patent is extended or adjusted under 35 U.S.C. 154(b) by 0 days.

(21) Appl. No.: 17/556,406

(22) Filed: Dec. 20, 2021

(51) Int. Cl.
*F02M 35/10* (2006.01)
*F02M 35/02* (2006.01)
*F02M 35/12* (2006.01)

(52) U.S. Cl.
CPC .. *F02M 35/10091* (2013.01); *F02M 35/0218* (2013.01); *F02M 35/10144* (2013.01); *F02M 35/10281* (2013.01); *F02M 35/1233* (2013.01)

(58) Field of Classification Search
CPC ..... F02M 35/10091; F02M 35/10144; F02M 35/0218; F02M 35/12; F02M 35/1233; F02M 35/10281; F02B 27/0247
See application file for complete search history.

(56) References Cited

U.S. PATENT DOCUMENTS

2007/0292816 A1 12/2007 Miller
2010/0089372 A1* 4/2010 Bellis ..... F02M 25/089 123/573
2016/0059468 A1* 3/2016 Khami ..... F02M 33/043 264/516
2017/0157556 A1* 6/2017 Karode ..... B01D 71/56
2019/0195172 A1 6/2019 Worrall
2020/0182205 A1* 6/2020 Moyer ..... F02M 35/10281

* cited by examiner

*Primary Examiner* — Jacob M Amick

(57) ABSTRACT

An air induction system includes an air duct and an air permeable membrane. The air duct is configured to deliver intake air to an engine. The air duct includes a cylindrical wall defining a bore and an enclosure projecting from an outer radial surface of the cylindrical wall and defining a cavity therein. The cylindrical wall has an opening extending therethrough that enables airflow from the bore to the cavity in the enclosure. The air permeable membrane is configured to cover the opening in the cylindrical wall.

20 Claims, 7 Drawing Sheets

AIR INDUCTION SYSTEM INCLUDING AIR DUCT HAVING CYLINDRICAL WALL WITH OPENING EXTENDING RADIALLY THERETHROUGH AND FEATURE FOR MINIMIZING AIRFLOW DISTURBANCES CAUSED BY PRESENCE OF OPENING

FIELD OF INVENTION

The present disclosure relates to air induction systems including an air duct having a cylindrical wall with an opening extending radially therethrough and a feature for minimizing airflow disturbances caused by the presence of the opening.

BACKGROUND

The background description provided here is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Air induction systems for an engine typically include an air cleaner, a rigid air duct, and a flexible air duct. The air cleaner receives intake air from the environment and filters the intake air. The rigid and flexible air ducts collectively form a connection between the air cleaner and the engine that delivers the filtered intake air to the engine. In addition, the rigid air duct provides a suitable structure for mounting components such as sensors, and the flexible air duct enables the engine to move relative to the air cleaner and the rigid air duct without damaging the air cleaner or the rigid air duct.

The sensors measure properties of intake air flowing through the rigid air duct. Some air induction systems include a hydrocarbon trap and/or an acoustic resonator, which may also be mounted to the rigid air duct. The hydrocarbon trap reduces hydrocarbon emissions in fuel vapor that flows from the engine to the air cleaner when the engine is off. The acoustic resonator reduces the amount of noise transmitted from the engine to its surroundings.

SUMMARY

A first example of an air induction system according to the present disclosure includes an air duct and an air permeable membrane. The air duct is configured to deliver intake air to an engine. The air duct includes a cylindrical wall defining a bore and an enclosure projecting from an outer radial surface of the cylindrical wall and defining a cavity therein. The cylindrical wall has an opening extending therethrough that enables airflow from the bore to the cavity in the enclosure. The air permeable membrane is configured to cover the opening in the cylindrical wall.

In one aspect, the air permeable membrane reduces disturbances of airflow through the bore caused by the opening in the cylindrical wall while allowing airflow from the bore to the cavity through the opening.

In one aspect, the air permeable membrane is made of a non-woven polyester felt.

In one aspect, the air permeable membrane is made of a polyether ether ketone (PEEK) mesh material.

In one aspect, the air permeable membrane is made of a hydrocarbon paper.

In one aspect, the air induction system further includes a cage configured to fit within the bore in the air duct and to retain the air permeable membrane over the opening in the cylindrical wall of the air duct.

In one aspect, the cage includes a sidewall having a cylindrical shape with a window extending through the sidewall, and the air permeable membrane covers the window and is attached to a perimeter edge of the window.

In one aspect, the air induction system further includes a sensor projecting through the cylindrical wall at a location that is opposite of the opening in the cylindrical wall.

In one aspect, the sensor is a mass airflow sensor.

In one aspect, the air induction system further includes a hydrocarbon trap disposed within the enclosure.

In one aspect, the air induction system further includes an acoustic resonator disposed within the enclosure.

In one aspect, the air induction system further includes an air cleaner configured to filter the intake air. The air duct is attached to the air cleaner and is configured to form at least part of a connection between the air cleaner and the engine.

A second example of an air induction system includes an air duct and foam. The air duct is configured to deliver intake air to an engine. The air duct includes a cylindrical wall defining a bore and an enclosure projecting from an outer radial surface of the cylindrical wall and defining a cavity therein. The cylindrical wall has an opening extending therethrough that enables airflow from the bore to the cavity in the enclosure. The foam is configured to fill at least a portion of the cavity in the enclosure.

In one aspect, the foam is impregnated with carbon.

In one aspect, the foam is reticulated foam.

In one aspect, the foam is configured to cover the opening in the cylindrical wall.

A third example of an air induction system includes an air duct and first bars. The air duct is configured to deliver intake air to an engine. The air duct includes a cylindrical wall defining a bore and an enclosure projecting from an outer radial surface of the cylindrical wall and defining a cavity therein. The cylindrical wall has an opening extending therethrough that enables airflow from the bore to the cavity in the enclosure. The first bars extend across the opening in the cylindrical wall.

In one aspect, the first bars extend across the opening in a first direction parallel to a length of the bore in the air duct.

In one aspect, the air induction system further includes second bars that extend across the opening in a second direction parallel to a circumference of the bore in the air duct. The second bars intersect the first bars to form a grid.

In one aspect, the air induction system further includes at least one of an air permeable membrane and foam configured to cover the opening in the cylindrical wall. The first bars inhibit movement of the at least one of the air permeable membrane and the foam through the opening in the cylindrical wall.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

In an air induction system according to the present disclosure, the rigid air duct includes a cylindrical wall defining a bore for intake airflow, an enclosure defining a cavity for a hydrocarbon trap, and an opening extending through the cylindrical wall to enable airflow from the bore to the cavity. In addition, the air induction system includes a mass airflow sensor that projects through the cylindrical wall at a location that is opposite of the opening. The mass airflow sensor measures the mass flow rate of intake air flowing through the bore and does so most accurately when the intake airflow is laminar and homogeneous. The opening in the cylindrical wall can disturb the flow of intake air through the bore, and thereby cause the intake airflow to be turbulent and nonhomogeneous. In turn, the mass flow rate measured by the mass airflow sensor may be inaccurate.

To improve the accuracy of the mass airflow sensor, the air induction system includes one or more features for minimizing intake airflow disturbances caused by the opening in the cylindrical wall of the rigid air duct. In one example, the air induction system includes a cage that fits within the bore of the rigid air duct and retains an air permeable membrane over the opening in the cylindrical wall. The air permeable membrane improves the laminarity and homogeneity of intake airflow through the bore while allowing airflow to the cavity in the enclosure of the rigid air duct.

In another example, the air induction system includes foam that fills at least a portion of the cavity in the enclosure of the rigid air duct and covers the opening in the cylindrical wall of the rigid air duct without extending through the opening and into the bore. In yet another example, the air induction system includes horizontal bars extending across the opening and may include vertical bars extending across the opening and intersecting the horizontal bars to form a grid. Like the air permeable membrane, the foam and the bars improve the laminarity and homogeneity of intake airflow through the bore while allowing airflow to the cavity in the enclosure.

Variations of the above examples are also within the scope of the present disclosure. For example, the mass airflow sensor may be a different type of sensor, such as an intake air temperature sensor, and/or the enclosure of the rigid air duct may house an acoustic resonator instead of or in addition to the hydrocarbon trap. In another example, the cage may be omitted, and the air permeable membrane may be directly attached to the rigid air duct. In yet another example, the air permeable membrane and/or the foam may be disposed in the cavity in the enclosure of the rigid air duct, and the bars may prevent the air permeable membrane and/or the foam from moving from the cavity to the bore through the opening.

Figure 1:
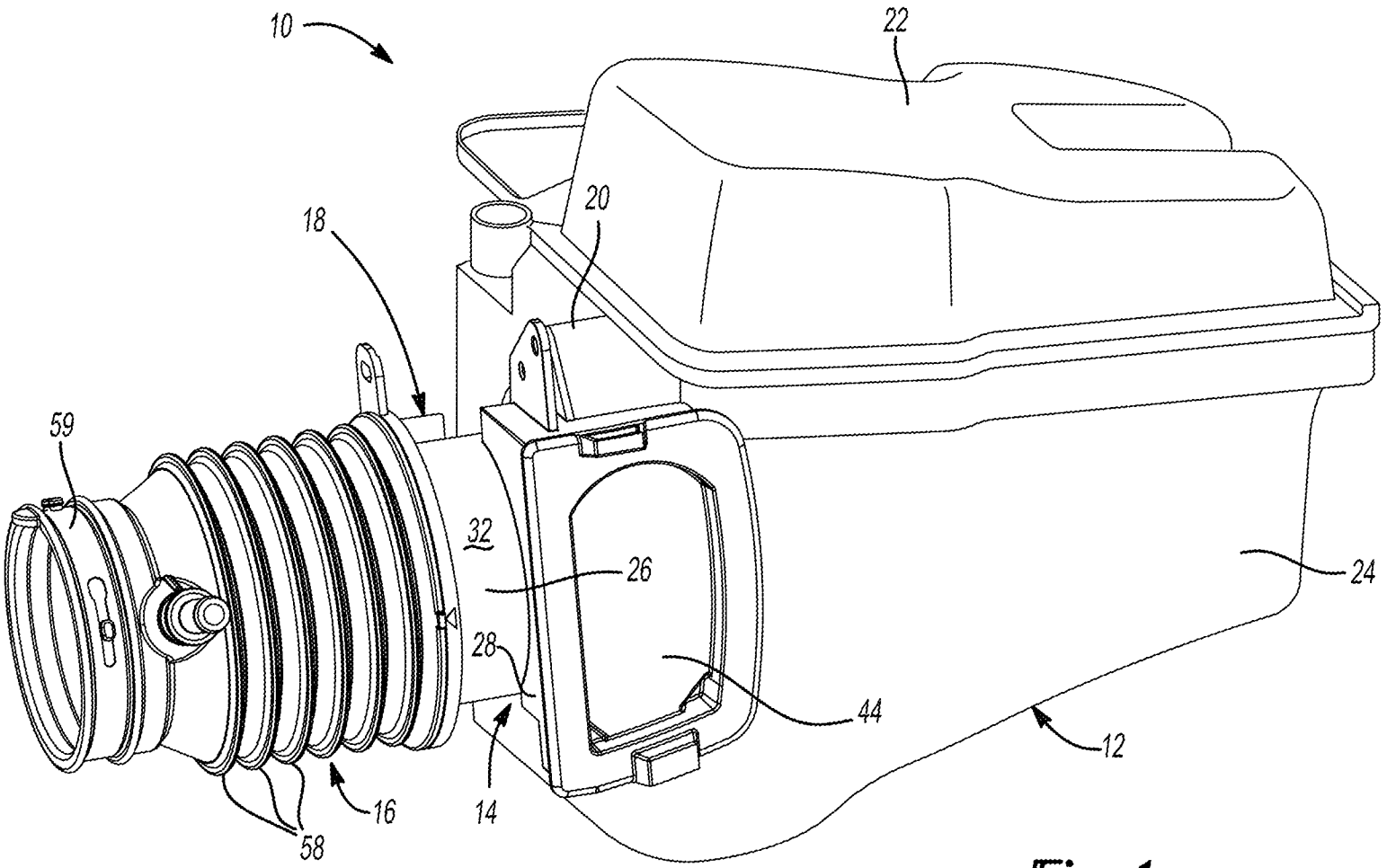
FIG. 1 is a perspective view of an air induction system according to the principles of the present disclosure, the air induction system including an air cleaner, a rigid air duct, a flexible air duct, and a mass airflow sensor coupled to the rigid air duct.
Figure 2:
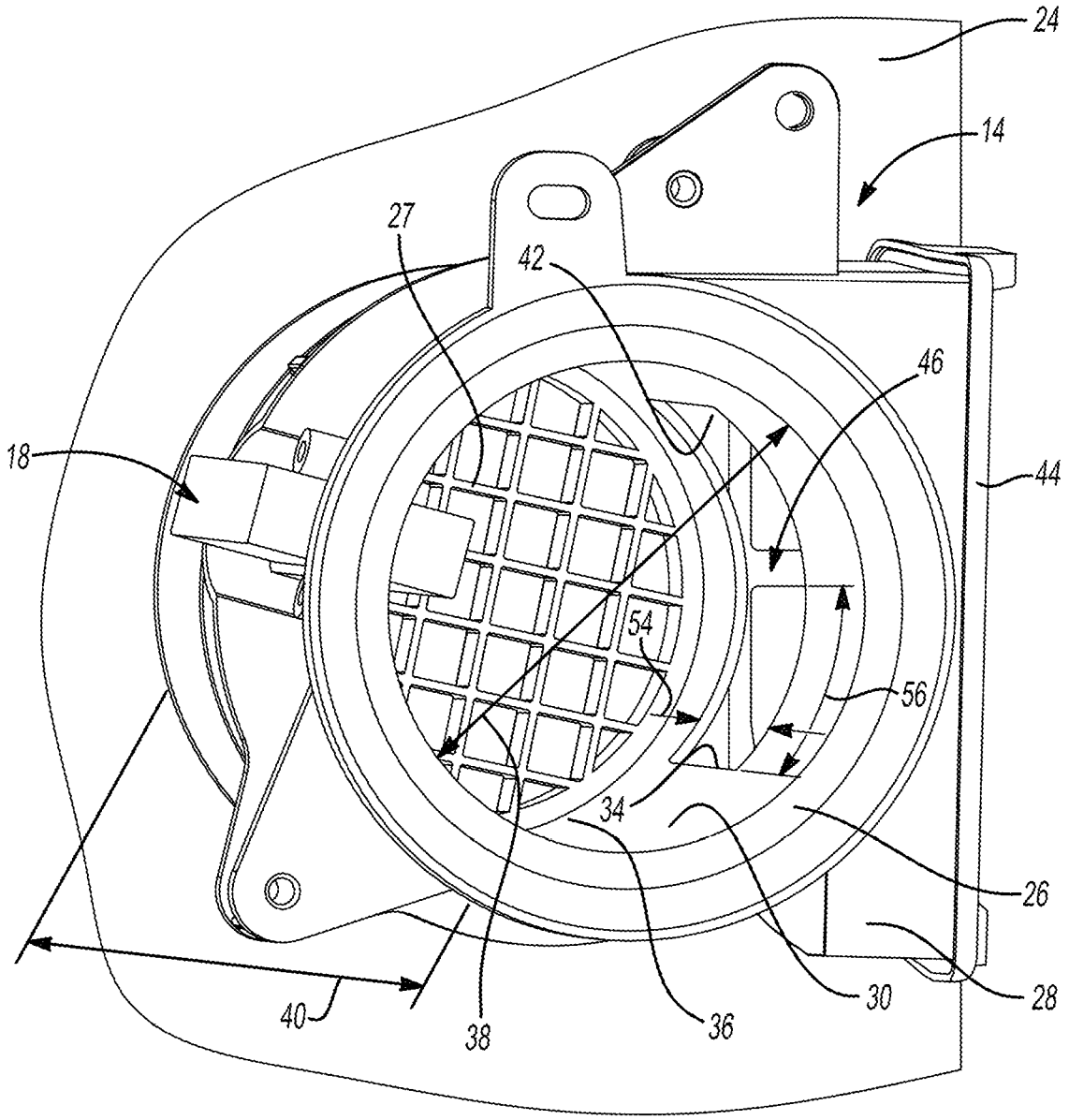
FIG. 2 is a perspective view of a portion of the air induction system of FIG. 1 with the flexible air duct removed to show an opening extending through a cylindrical wall of the rigid air duct to enable airflow to an enclosure attached to the cylindrical wall.

Referring now to FIGS. 1 and 2, an air induction system 10 includes an air cleaner 12, a rigid air duct 14, a flexible air duct 16, and a mass air flow sensor 18. The air cleaner 12 receives intake air from the environment and filters the intake air. The rigid and flexible air ducts 14 and 16 collectively form a connection between the air cleaner 12 and an engine (not shown) that delivers the filtered intake air to the engine. The air cleaner 12 has an inlet port (not shown) that receives the intake air from the environment and an outlet port 20 that expels the filtered ambient air to the rigid air duct 14. The air cleaner 12 includes an upper housing 22, a lower housing 24 attached to the upper housing 22 to form a filter housing, and an air filter (not shown) disposed within the filter housing.

The rigid air duct 14 delivers intake air from the air cleaner 12 to the flexible air duct 16. The upper and lower housings 22 and 24 of the air cleaner 12 and the rigid air duct 14 are made of a rigid material such as plastic. The rigid air duct 14 includes a cylindrical wall 26, a flow straightener screen 27, and an enclosure 28. The cylindrical wall 26 of the rigid air duct 14 has an inner radial surface 30 (FIG. 2), an outer radial surface 32 (FIG. 1), and an opening 34 extending through the inner and outer radial surfaces 30 and 32. The inner radial surface 30 of the cylindrical wall 26 defines a bore 36 having a diameter 38 and a length 40. Filtered intake air flows from the air cleaner 12 to the flexible air duct 16 through the bore 36 of the rigid air duct 14.

The flow straightener screen 27 of the rigid air duct 14 is disposed at the inlet of the bore 36. The flow straightener screen 27 improves the laminarity and homogeneity of intake airflow through the rigid air duct 14. The enclosure 28 of the rigid air duct 14 projects from the outer radial surface 32 of the cylindrical wall 26 and defines a cavity 42 therein. The enclosure 28 may be box-shaped as shown. A cover 44 fits onto the enclosure 28 to seal the cavity 42 from the environment.

Figure 4:
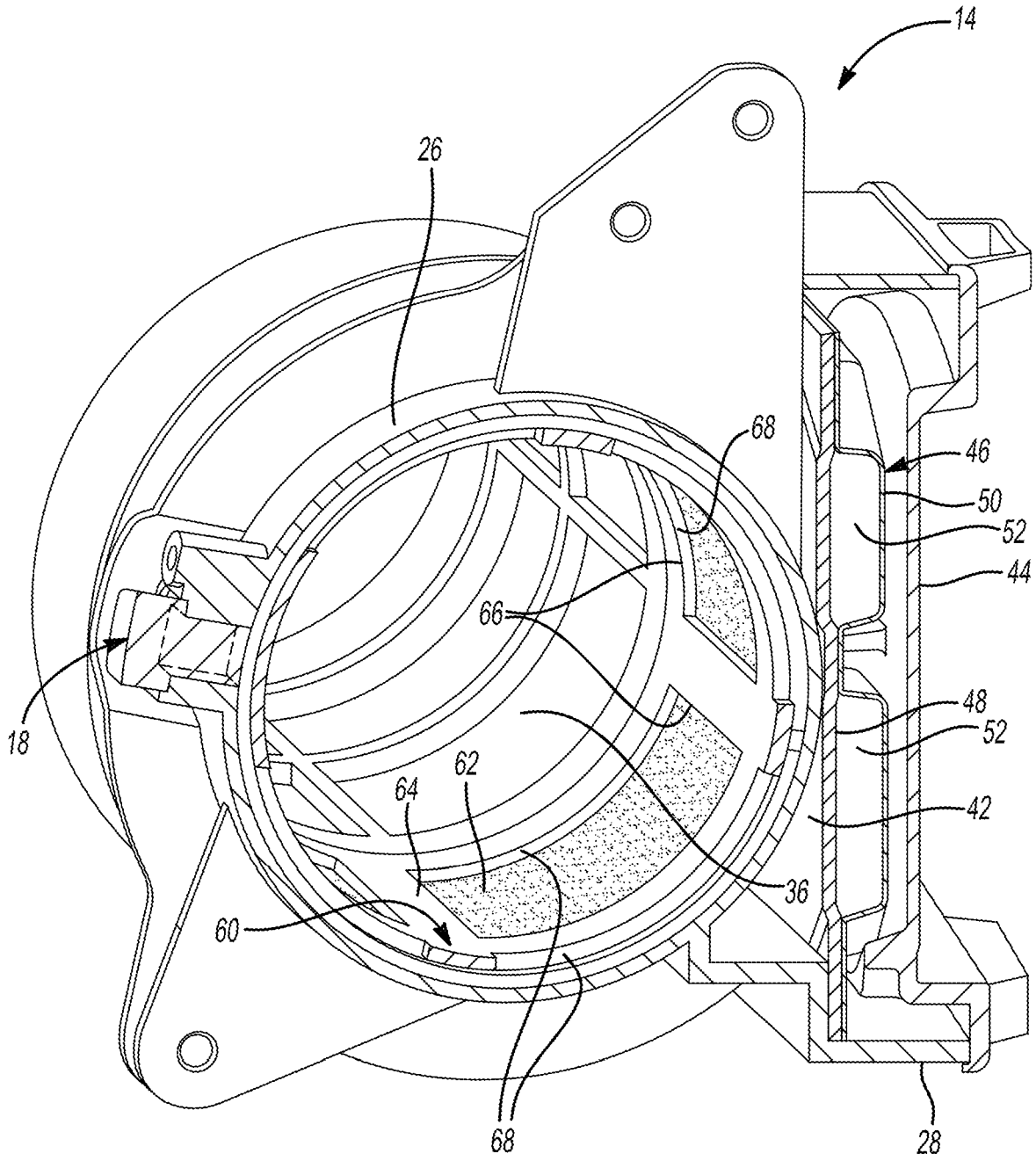
FIG. 4 is sectioned perspective view of the air induction system of FIG. 1 with the cage of FIG. 3 inserted in the rigid air duct.

A hydrocarbon trap 46 is disposed within the enclosure 28. The hydrocarbon trap 46 removes hydrocarbon from fuel vapor flowing from the engine to the air cleaner 12 through the rigid air duct 14 when the engine is off. Referring briefly to FIG. 4, the hydrocarbon trap 46 includes a non-woven felt 48 and a carbon housing 50 that cooperates with the non-woven felt 48 to form pockets 52. The pockets 52 are filled with carbon that is activated and/or granulated. The non-woven felt 48 and the carbon absorb hydrocarbon from fuel vapor that flows into the cavity 42 of the enclosure 28. In various implementations, an acoustic resonator may be disposed within the enclosure 28 in addition to or in place of the hydrocarbon trap 46.

Referring again to FIGS. 2 and 3, the opening 34 in the cylindrical wall 26 of the rigid air duct 14 enables fuel vapor to flow from the bore 36 in the rigid air duct 14 to the cavity 42 in the enclosure 28. The opening 34 has a width 54 and a height 56. The width 54 of the opening 34 extends along the length 40 of the bore 36, and the height 56 of the opening 34 extends along the circumference of the cylindrical wall 26. The width 54 of the opening 34 is greater than one-quarter of the length 40 of the bore 36. The height 56 of the opening 34 is greater than one-quarter of the diameter 42 of the bore 36.

The flexible air duct 16 delivers air from the rigid air duct 14 to the engine while allowing the engine to move relative to the air cleaner 12 and the rigid air duct 14. The flexible air duct 16 is made of a flexible material such as rubber. In addition, the flexible air duct 16 includes bellow-shaped ridges 58 that provide additional flexibility. A hose claim 59 may secure the flexible air duct 16 to a throttle valve of the engine.

The mass airflow sensor 18 projects through the cylindrical wall 26 of the rigid air duct 14 at a location that is opposite of the opening 34 in the cylindrical wall 26. The mass airflow sensor 18 measures the mass flow rate of intake air flowing through the rigid air duct 14 and does so most accurately when the intake airflow is laminar and homogeneous. The opening 34 in the cylindrical wall 26 can disturb the flow of intake air through the rigid air duct 14, and thereby cause the intake airflow to be turbulent and nonhomogeneous, even with the flow straightener screen 27 in the bore 36. In turn, the mass flow rate measured by the mass airflow sensor 18 may be inaccurate.

To improve the accuracy of the mass airflow sensor 18, the air induction system 10 includes one or more features for minimizing intake airflow disturbances caused by the opening 34. For example, referring now to FIG. 3, the air induction system 10 further includes a cage 60 that fits within the bore 36 in the rigid air duct 14 and retains one or more air permeable membranes 62 over the opening 34 in the cylindrical wall 26 of the rigid air duct 14. The cage 60 includes a sidewall 64 having a cylindrical shape with windows 66 extending through the sidewall 64. The air permeable membranes 62 cover at least some of the windows 66 and are attached to perimeter edges 68 of the windows 66. The mass airflow sensor 18 may extend through one of the windows 66 that is not covered by the air permeable membranes 62. The cage 60 may be made of plastic.

When the cage 60 is inserted into the bore 36 of the rigid air duct 14 as shown, the air permeable membranes 62 cover the opening 34 in the cylindrical wall 26. In turn, the air permeable membranes 62 reduce disturbances of airflow through the bore 36 caused by the opening 34 in the cylindrical wall 26 while allowing airflow from the bore 36 to the cavity 42 through the opening 34. The air permeable membranes 62 may be made of a non-woven polyester felt, a polyether ether ketone (PEEK) mesh material, an activated hydrocarbon paper, a porous acoustic duct material, or a combination thereof.

The cage 60 may be secured within the bore 36 of the rigid air duct 14 using a tongue-and-groove connection. For example, the cylindrical wall 26 of the rigid air duct 14 may define an alignment slot (not shown) that extends along the length 40 of the bore 36, and the cage 60 may include a tongue (not shown) that projects radially outward from the sidewall 64 of the cage 60. In this example, the cage 60 may be secured within the bore 36 of the rigid air duct 14 by sliding the tongue on the cage 60 into the alignment slot in the cylindrical wall 26 of the rigid air duct 14. Additionally or alternatively, the cage 60 may be secured within the bore 36 using a fastener, a weld, an interference bead, a detent mechanism, or a combination thereof.

The air permeable membranes 62 may be attached to the perimeter edges 68 of the window 66 in the cage 60 using heat staking or adhesive. In various implementations, the cage 60 may be omitted, and the air permeable membrane(s) 62 may be positioned over the opening 34 in the cylindrical wall 26 and directly attached to the cylindrical wall 26 using, for example, heat staking or adhesive. The air permeable membrane(s) 62 may be attached to the inner radial surface 30 of the cylindrical wall 26 and/or the outer radial surface 32 of the cylindrical wall 26.

Figure 5:
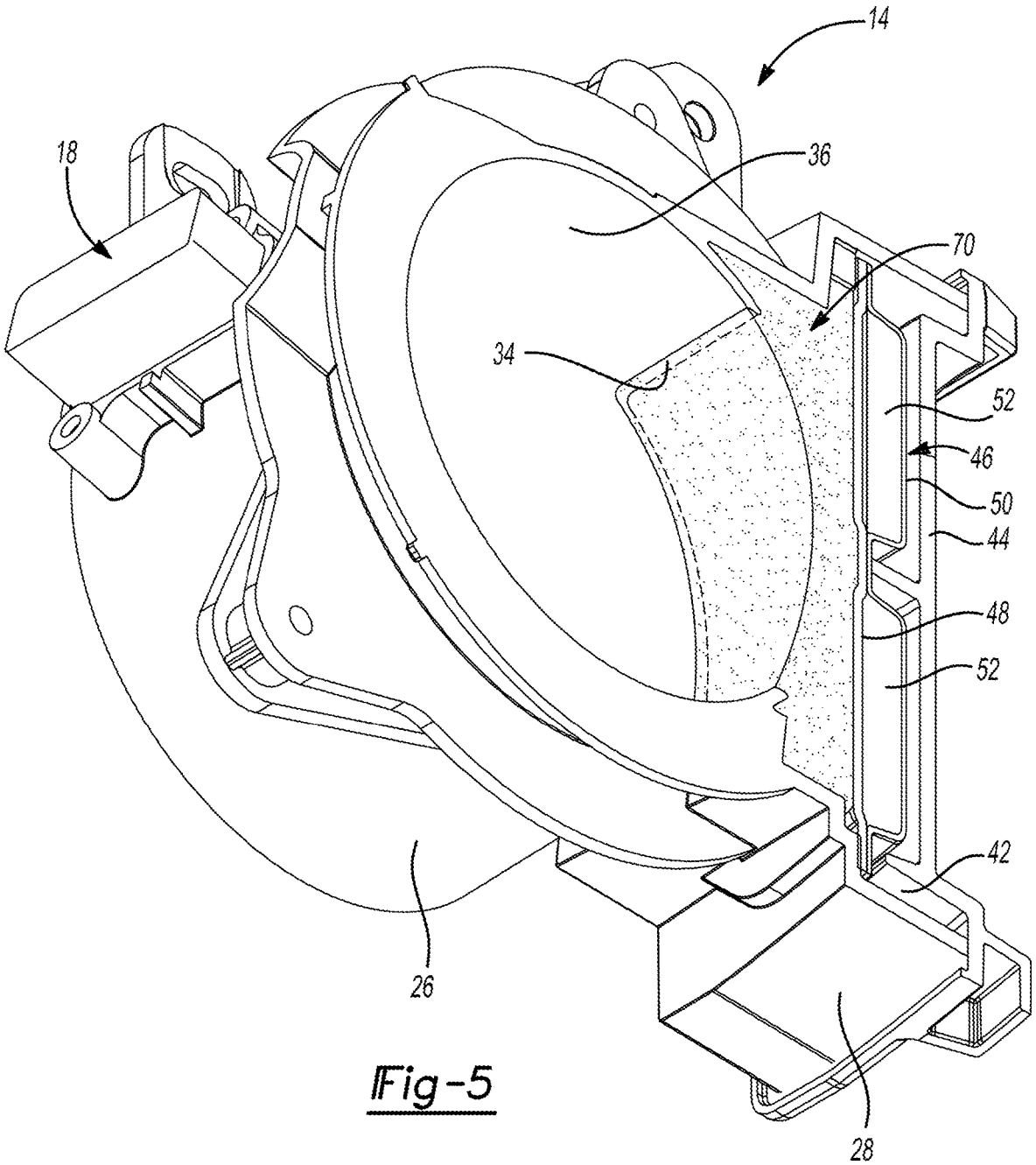
FIG. 5 is a sectioned perspective view of the rigid air duct of FIG. 1 with foam filling the cavity in the enclosure and conforming to the opening in the cylindrical wall.

Referring now to FIG. 5, the rigid air duct 14 is shown with a foam 70 filling the at least a portion of the cavity 42 in the enclosure 28. In the example shown, the foam 70 fills the portion of the cavity 42 between the cylindrical wall 26 and the hydrocarbon trap 46, covers the opening 34 in the cylindrical wall 26, and conforms to the shape of the opening 34. The foam 70 may be reticulated foam and/or impregnated with carbon. Like the air permeable membranes 62 of FIGS. 3 and 4, the foam 70 reduces disturbances of airflow through the bore 36 caused by the opening 34 in the cylindrical wall 26 while allowing airflow from the bore 36 to the cavity 42 through the opening 34. In addition, the foam 70 may increase the capacity of the hydrocarbon trap 46.

The foam 70 may be captured between the cylindrical wall 26, the enclosure 28, and the hydrocarbon trap 46 without attaching the foam 70 to any of these components. Alternatively, the foam 70 may be attached to the outer radial surface 32 of the cylindrical wall 26 and/or to the hydrocarbon trap 46 using, for example, heat staking or fasteners. In various implementations, the foam 70 may be attached (e.g., heat staked, fastened) to a frame (not shown) that is inserted into the cavity 42 of the enclosure 28.

Figure 6:
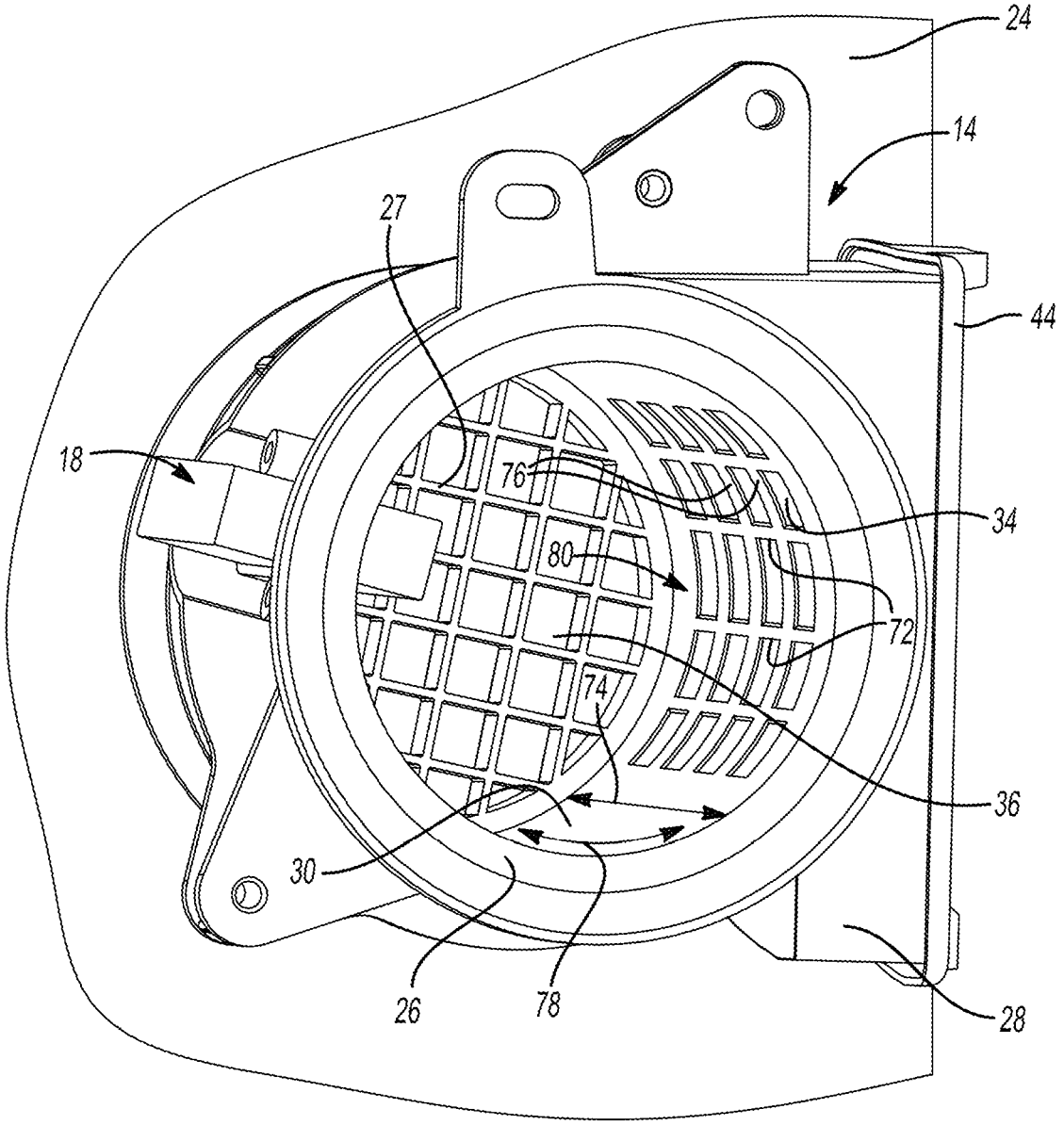
FIGS. 6 and 7 are perspective views of the rigid air duct of FIG. 1 with horizontal and vertical bars extending across the opening in the cylindrical wall to form a grid.
Figure 7:
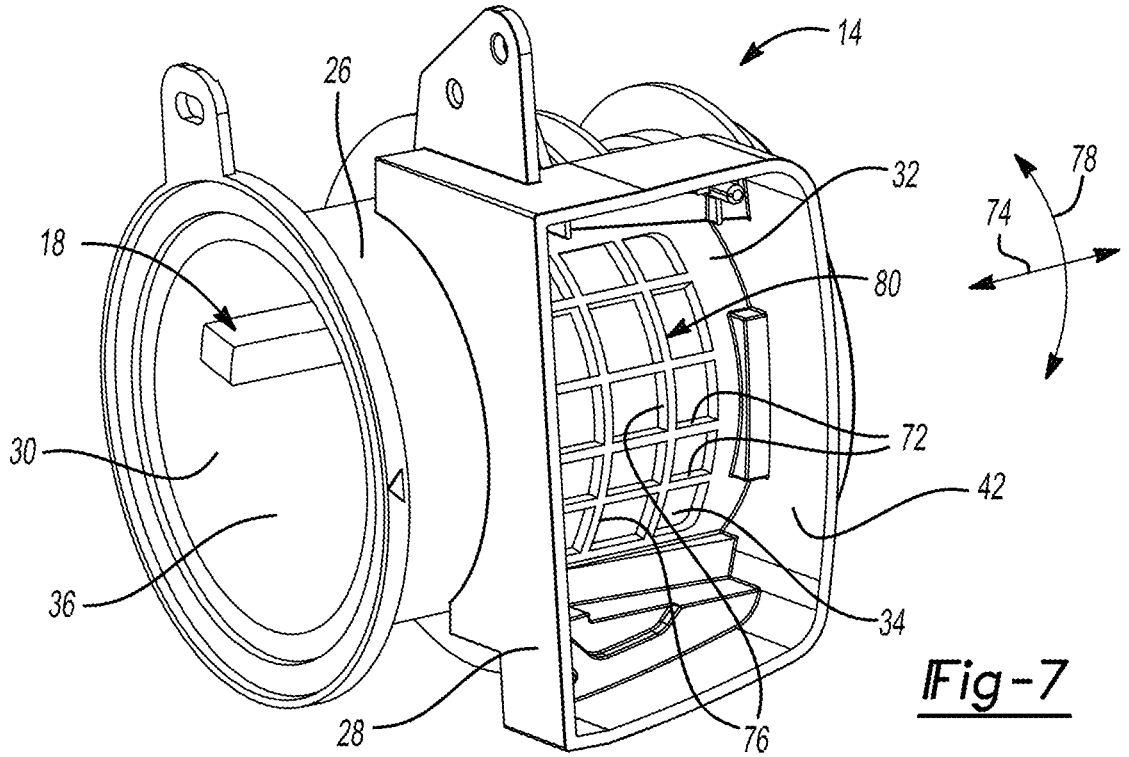

Referring now to FIGS. 6 and 7, the rigid air duct 14 is shown with first bars 72 extending across the opening 34 in the cylindrical wall 26 in a first direction 74, and second bars 76 extending across the opening 34 in a second direction 78. The first direction 74 is parallel to the length 40 of the bore 36 in the rigid air duct 14. The second direction 80 is parallel to the circumference of the bore 36 in the rigid air duct 14. The second bars 76 intersect the first bars 72 to form a grid 80. Like the foam 70 of FIG. 5, the grid 80 reduces disturbances of airflow through the bore 36 caused by the opening 34 while allowing airflow from the bore 36 to the cavity 42 through the opening 34.

Figure 3:
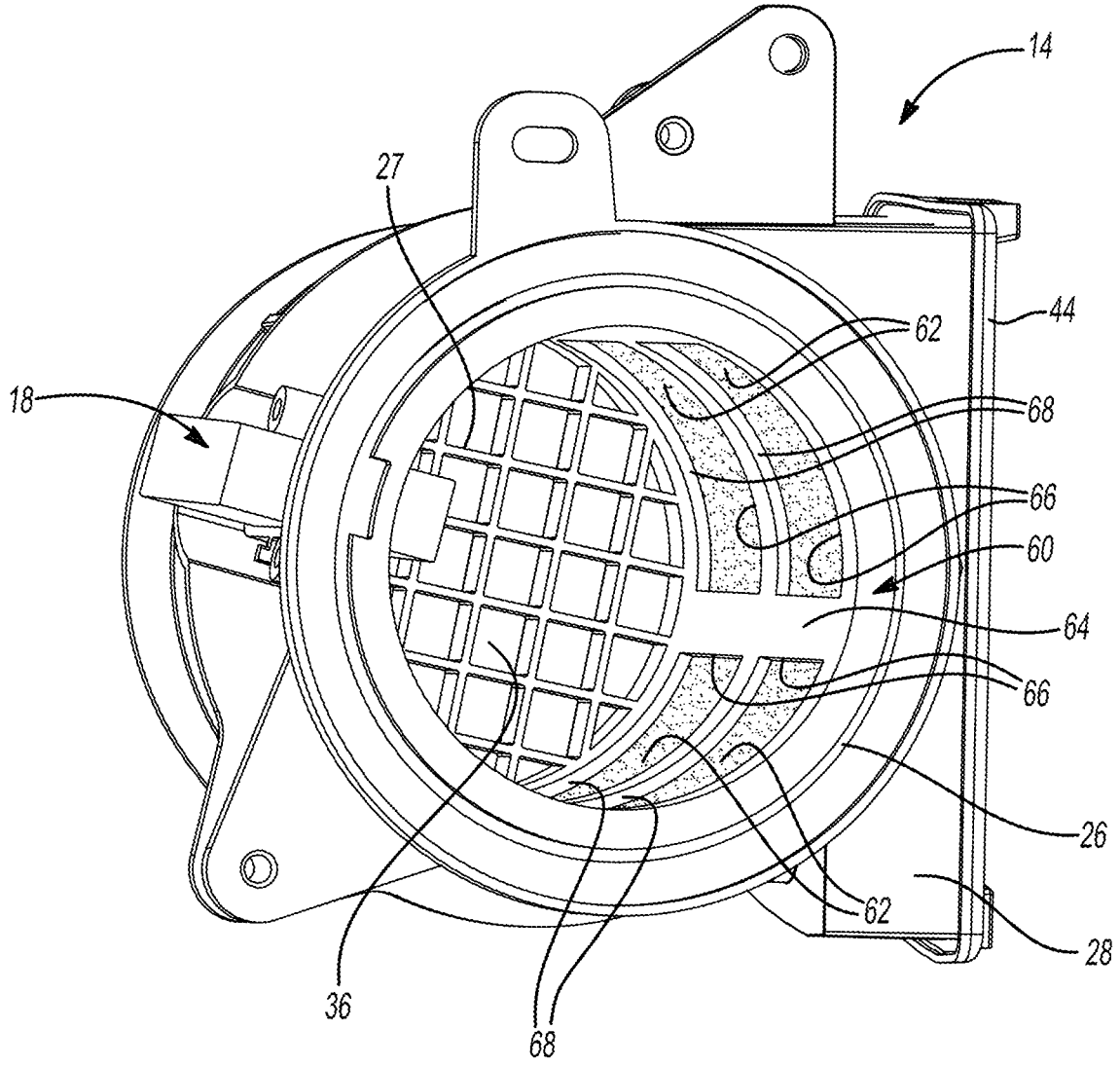
FIG. 3 is a perspective view of the air induction system of FIG. 1 with a cage according to the principles of the present disclosure inserted into the rigid air duct, the cage carrying air permeable membranes that cover the opening in the rigid air duct.

The air induction system 10 may incorporate the grid 80 in addition to the air permeable membrane(s) 62 of FIGS. 3 and 4 or the foam 70 of FIG. 5. For example, the air permeable membrane(s) 62 or the foam 70 may be positioned in the cavity 42 between the grid 80 and the hydrocarbon trap 46. In addition, the air permeable membrane(s) 62 or the foam 70 may be attached to the outer radial surface 32 of the cylindrical wall 26. The grid 80 may inhibit movement of the air permeable membrane(s) 62 or the foam 70 through the opening 34. For example, the grid 80 may prevent movement of the air permeable membrane(s) 62 or the foam 70 from the cavity 42 in the enclosure 28 to the bore 36 in the rigid air duct 14 through the opening 34.

Figure 8:
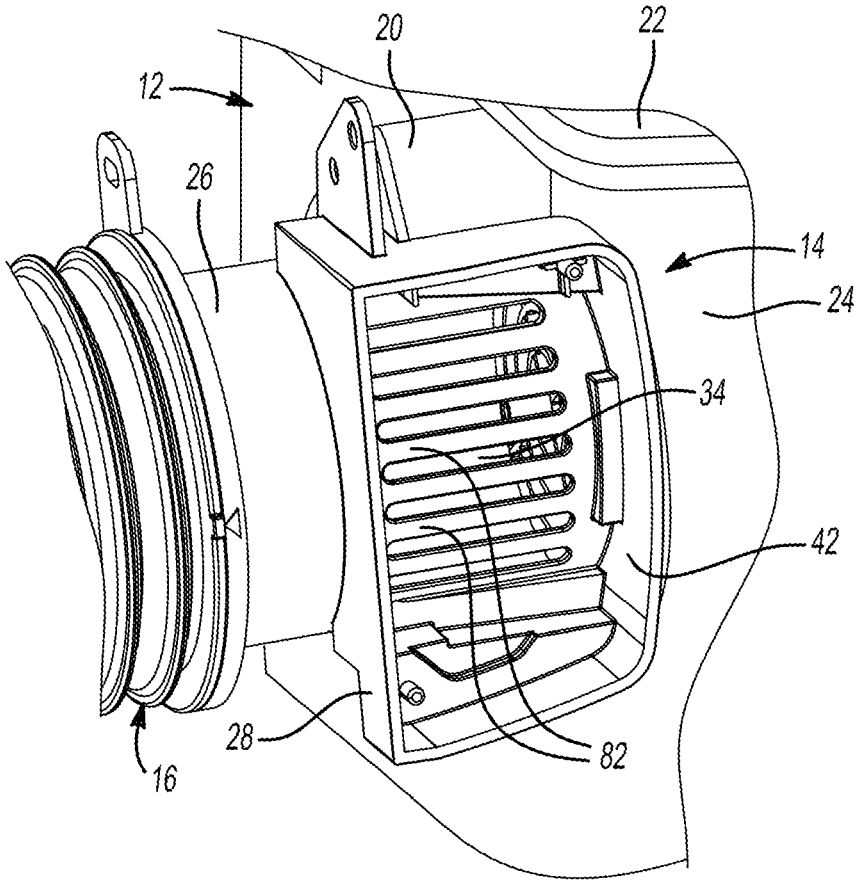
FIG. 8 is a perspective view of a portion of the air induction system of FIG. 1 with the rigid air duct including only horizontal bars that extend across the opening in the cylindrical wall.

Referring now to FIG. 8, the rigid air duct 14 is shown with bars 82 extending across the opening 34 in the first direction 74 and without bars extending across the opening 34 in the second direction 78. Like the grid 80 of FIGS. 6 and 7, the bars 82 reduce airflow disturbances caused by the opening 34 in the cylindrical wall 26. The absence of bars extending across the opening 34 in the second direction 78 may make airflow through the rigid air duct 14 more homogeneous and laminar. In addition, the air permeable membrane(s) 62 or the foam 70 may be positioned in the cavity 42 between the grid 80 and the hydrocarbon trap 46, and the bars 82 may inhibit movement of the air permeable membrane(s) 62 or the foam 70 through the opening 34.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. An air induction system comprising:

an air duct configured to deliver intake air to an engine, the air duct including:

a cylindrical wall comprising an inner radial surface and an outer radial surface, the cylindrical wall defining a bore; and an enclosure projecting from the outer radial surface of the cylindrical wall and defining a cavity therein, the cylindrical wall having an opening extending between the inner radial surface and the outer radial surface that enables airflow from the bore to the cavity in the enclosure; and an air permeable membrane that conforms to at least one of the inner radial surface or the outer radial surface and that is configured to cover the opening in the cylindrical wall.

2. The air induction system of claim 1 wherein the air permeable membrane reduces disturbances of airflow through the bore caused by the opening in the cylindrical wall while allowing airflow from the bore to the cavity through the opening.

3. The air induction system of claim 1 wherein the air permeable membrane is made of a non-woven polyester felt.

4. The air induction system of claim 1 wherein the air permeable membrane is made of a polyether ether ketone (PEEK) mesh material.

5. The air induction system of claim 1 wherein the air permeable membrane is made of a hydrocarbon paper.

6. The air induction system of claim 1 further comprising a cage configured to fit within the bore in the air duct and to retain the air permeable membrane over the opening in the cylindrical wall of the air duct.

7. The air induction system of claim 6 wherein the cage includes a sidewall having a cylindrical shape with a window extending through the sidewall, and the air permeable membrane covers the window and is attached to a perimeter edge of the window.

8. The air induction system of claim 1 further comprising a sensor projecting through the cylindrical wall at a location that is opposite of the opening in the cylindrical wall.

9. The air induction system of claim 8 wherein the sensor is a mass airflow sensor.

10. The air induction system of claim 1 further comprising a hydrocarbon trap disposed within the enclosure.

11. The air induction system of claim 1 further comprising an acoustic resonator disposed within the enclosure.

12. The air induction system of claim 1 further comprising an air cleaner configured to filter the intake air, wherein the air duct is attached to the air cleaner and is configured to form at least part of a connection between the air cleaner and the engine.

13. An air induction system comprising:

an air duct configured to deliver intake air to an engine, the air duct including:

a cylindrical wall comprising an inner radial surface and an outer radial surface, the cylindrical wall defining a bore; and an enclosure projecting from the outer radial surface of the cylindrical wall and defining a cavity therein, the cylindrical wall having an opening extending between the inner radial surface and the outer radial surface that enables airflow from the bore to the cavity in the enclosure; and foam that conforms to at least one of the inner radial surface or the outer radial surface and that is configured to fill at least a portion of the cavity in the enclosure.

14. The air induction system of claim 13 wherein the foam is impregnated with carbon.

15. The air induction system of claim 13 wherein the foam is reticulated foam.

16. The air induction system of claim 13 wherein the foam is configured to cover the opening in the cylindrical wall.

17. An air induction system comprising:

an air duct configured to deliver intake air to an engine, the air duct including:

a cylindrical wall comprising an inner radial surface and an outer radial surface, the cylindrical wall defining a bore; and an enclosure projecting from the outer radial surface of the cylindrical wall and defining a cavity therein, the cylindrical wall having an opening extending between the inner radial surface and the outer radial surface that enables airflow from the bore to the cavity in the enclosure;

at least one of an air permeable membrane or foam that conforms to at least one of the inner radial surface or the outer radial surface and that is configured to cover the opening in the cylindrical wall; and first bars that extend across the opening in the cylindrical wall.

18. The air induction system of claim 17 wherein the first bars extend across the opening in a first direction parallel to a length of the bore in the air duct.

19. The air induction system of claim 18 further comprising second bars that extend across the opening in a second direction parallel to a circumference of the bore in the air duct, wherein the second bars intersect the first bars to form a grid.

20. The air induction system of claim 17 wherein the first bars inhibit movement of the at least one of the air permeable membrane or the foam through the opening in the cylindrical wall.

* * * * *